US006170403B1

(12) United States Patent
Behringer

(10) Patent No.: US 6,170,403 B1
(45) Date of Patent: Jan. 9, 2001

(54) BOAT FOR SPILL WATER RAFT RIDES

(75) Inventor: Georg Behringer, Denzlingen (DE)

(73) Assignee: Heinrich Mack GmbH & Co., Waldkirch (DE)

( * ) Notice: Under 35 U.S.C. 154(b), the term of this patent shall be extended for 0 days.

(21) Appl. No.: 09/233,535

(22) Filed: Jan. 20, 1999

(30) Foreign Application Priority Data

Jan. 21, 1998 (DE) ..... 198 01 960
Apr. 9, 1998 (DE) ..... 198 16 008

(51) Int. Cl.[7] ..... A63G 3/00

(52) U.S. Cl. ..... 104/59; 104/73; 104/139; 104/243; 104/245

(58) Field of Search ..... 104/59, 73, 139, 104/243, 245, 247

(56) References Cited

U.S. PATENT DOCUMENTS 3,391,652 * 7/1968 Lauber ..... 104/247
3,796,165 * 3/1974 Goode ..... 104/247
4,036,146 * 7/1977 Tyus ..... 104/1 R
5,613,443 * 3/1997 Ariga et al. ..... 104/70
5,732,635 * 3/1998 McKoy ..... 104/73

FOREIGN PATENT DOCUMENTS 83 36 946 U1 12/1983 (DE) .
83 36 946 U * 7/1985 (DE) ..... E01B/25/28

* cited by examiner

*Primary Examiner*—S. Joseph Morano
*Assistant Examiner*—Frantz Jules
(74) *Attorney, Agent, or Firm*—Foley, Hoag & Eliot LLP

(57) ABSTRACT

A boat for spillwater raft rides or similar rides having running gear includes running wheels and lateral guide wheels to accept a force exerted by a portion of the track. A safety device is provided that consists of safety wheels or runners. The latter are located above lateral guide wheels and designed to engage safety rails placed along the line to accept lifting forces.

17 Claims, 5 Drawing Sheets

10
18
16
14
22
30
28
20
V 18
16
14
20
26

BOAT FOR SPILL WATER RAFT RIDES

BACKGROUND OF THE INVENTION

1. Field of the Invention

The present invention relates to a boat for spillwater raft rides or the like.

2. Description of Related Art

Conventional spillwater raft rides, like those used in amusement parks and by showmen at fairs, festivals, or the like, as a rule have a path in which the boat, which can be occupied by several persons, floats in a canal that carries water. Spillwater raft rides are also known in which the boat, equipped with wheels, is lifted out of the water by an elevator, for example, and raised to a certain height from which it slides down a straight slope in order to make the ride more attractive. In the past, only slopes that had a straight path as seen in a plan view were used.

Although spillwater raft rides with such slopes enjoy a certain popularity, there is nevertheless the need, and not exclusively for reasons related to competition, to increase the attractiveness of these spillwater raft rides even further, for example by incorporating partial stretches that resemble roller coasters. The wheels on roller coaster cars normally have a plurality of axles which are movable in space relative to one another. The upper parts of the vehicles rest on these axles together with the passenger seats. Wheel guards are mounted on the corresponding axles to which different types of wheels are attached. These different types include wheels that accept the vertical forces acting on the vehicle and run on top of the rails, lateral guide wheels that determine the direction of the vehicle and run on the sides of the rails, and safety wheels or runners that abut the rails from below and prevent the vehicles from derailing when lifting forces act in certain sections of the line. It is noted that the rail cross section of a roller coaster remains constant over the entire length of the line. The wheels are set so that they guide the vehicle as closely as possible to the rails.

It is desirable to provide a boat that can also travel on sections of a path that have three-dimensional curves and transverse inclinations.

SUMMARY OF THE INVENTION

According to the present invention, a boat for a spillwater raft ride or the like uses a safety device that includes safety wheels or runners that are located above the lateral guide wheels and are designed to engage safety rails mounted along the track to accept lifting forces. Installation of the wheels can be facilitated by locating the running wheels, lateral guide wheels, and safety wheels or runners on a suitable axle. This also has the additional advantage that the hull of the boat has fewer weak points caused by mounting holes and as a result cannot become leaky as rapidly. Although a plurality of axles is possible, it has been found to be sufficient for the wheels to have two axles, a front axle and a rear axle on the boat. The guidance of the boat on sections of the track that resemble a roller coaster may be made simpler if the lateral guide wheels and the safety wheels and/or runners are located above the running wheels.

In order to permit longer boats for a larger number of passengers to travel safely through the three-dimensional curves of the track segments that resemble a roller coaster, it is advantageous for the rear axle to be pivotable about the lengthwise axis of the boat while the front axle is rigidly fastened to the boat, and therefore stabilization is provided.

According to another embodiment of the invention, the rear axle is pivotable by a pivot bearing, in which case it is advantageous for a restoring device to be provided that engages the pivotable rear axle in order to move the rear axle into the neutral position in the unloaded state, since this causes the boat to have less flow resistance. In order for the running wheels to follow the path of the tracks better, they are advantageously designed as pivoting rollers.

In order to provide better contact with the guide rails, it is advantageous for the pivot angle of the running wheels to be limited. This is advantageously possible when a limiting pin limits the pivot angle, with a fork-shaped extension of the running wheel mount fitting around this limiting pin. Since brakes are provided for the boat in order to brake it at the end of a descent and especially at the end of its trip, it is advantageous to provide a brake strip running lengthwise of the boat on its underside. This has the additional advantage that this brake strip stabilizes the boat during its travel in the water like a keel. In order to increase the service life of the running gear, it is advantageous for the wheels to be designed for operation under water. In order for the passengers to be held in place securely as they pass through three-dimensional curves, safety bars can be provided, for example, that can be locked at the level of the lower abdomen of the passengers.

The wheels of the boat according to the invention may therefore substantially meet the same requirements as the wheels of conventional roller coasters, and therefore likewise consist of running wheels, guide wheels, and safety wheels or runners. In addition, the wheels are so designed that a close fit to the rails is guaranteed and pivoting of at least one axle is allowed. The latter is especially advantageous when the front and rear axles have different transverse inclinations as they travel the route.

In contrast to roller coaster vehicles, boats for spillwater raft rides according to advantageous embodiments can also meet the requirements that follow because the boat or boats float in sections of the path that resemble canals: Guidance of the boat in the canal by the side wheels; "threading" the boat into the sections with three-dimensional curves; the chassis with wheels, bearings, and the like is reliably operable under water; supporting the boat by its wheels on the bottom of the canal if the water escapes from the canal.

The boats according to the invention can also traverse all of the three-dimensional curves familiar from roller coasters with different transverse inclinations in spillwater raft rides as well, including looping, with the character of a boat floating freely in a canal being retained in individual sections of the path.

Additional features and advantages of the invention will follow from the description below of an embodiment as well as from the drawings to which reference is made.

DETAILED DESCRIPTION OF THE PREFERRED EMBODIMENT(S)

Figure 1:
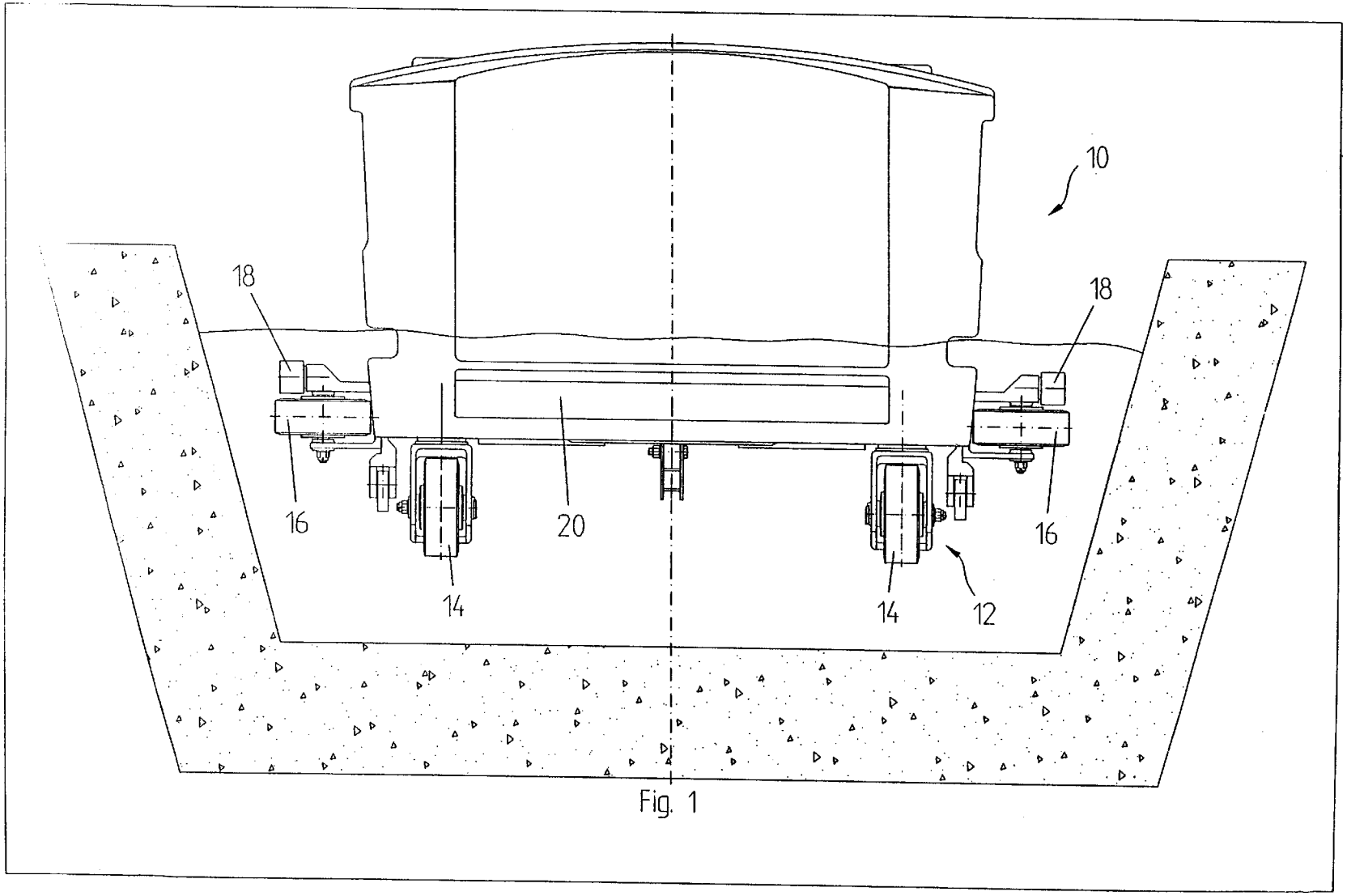
FIG. 1 shows a cross section through a boat floating in a canal containing water.

FIG. 1 shows a cross section of a boat 10 in a canal that is carrying water, with the boat floating. The boat 10 has running gear 12 which includes two wheels 14 per axle 20, 22 (see FIGS. 3 to 5). The wheels 14 essentially run parallel to the vertical axis of the boat 10, with two lateral guide wheels 16 that extend perpendicularly to the running wheels 14 being located in the lower areas of the outside walls of the boat 10. One of a pair of safety wheels 18 is located above an area of each of the lateral guide wheels 16 that is directed outward. The safety wheels 18 are able to rotate perpendicularly to the lateral guide wheels 16. Instead of safety wheels 18, runners (not shown) could also be used.

Figure 2:
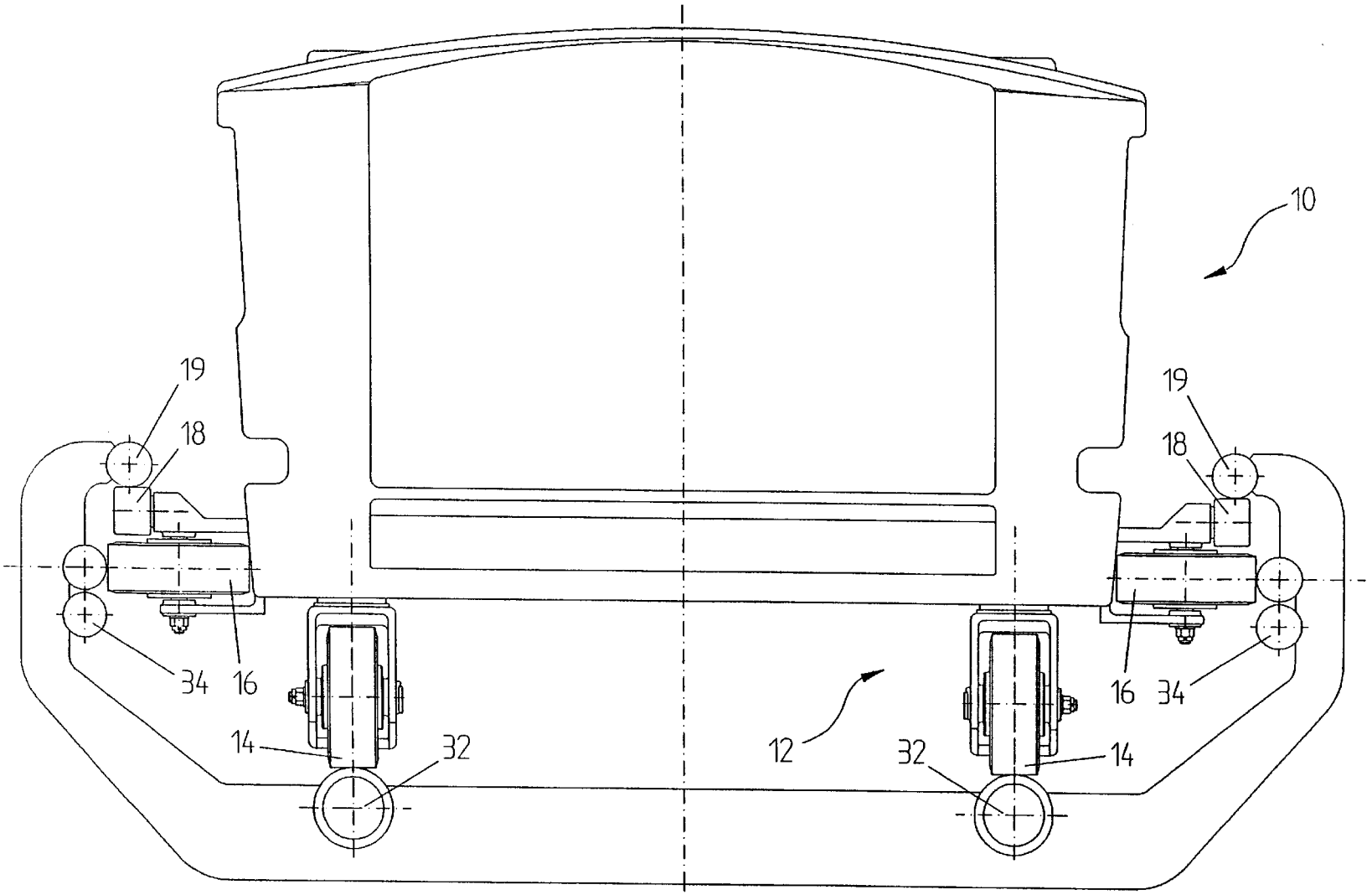
FIG. 2 shows a cross section of the boat guided on a route that is formed by traveling rails, safety rails, and side rails.

In FIG. 2, the same cross section of the boat 10 according to FIG. 1 is shown, but in this case on a portion of the track with three-dimensional curves. The wheels 14 roll on a pair of rails 32 while the lateral guide wheels 16 roll on a pair of side rails 34 located along the portion of the track on inner sections of legs of the track that is U-shaped in cross section, A pair of safety rails 19 are located at free ends of the legs of the U-shaped sections of the line. The rails 19 are engaged from below by the safety wheels 18. In the embodiment shown in FIG. 2, the free ends of the legs of the U-shaped section of the track are each bent inward in order to simplify installation of the safety rails 19 at the corresponding positions to engage the safety wheels 18. For so-called "threading" of the running gear 12 of the boat 10 into the portions of the track with three-dimensional curves, at the beginning of the sections of the track the safety rails 19 can be bent slightly upward so that the safety wheels 18 can be caused to engage the portion of the track and grip the safety rails 19 from below.

Figures 3, 4, 5:
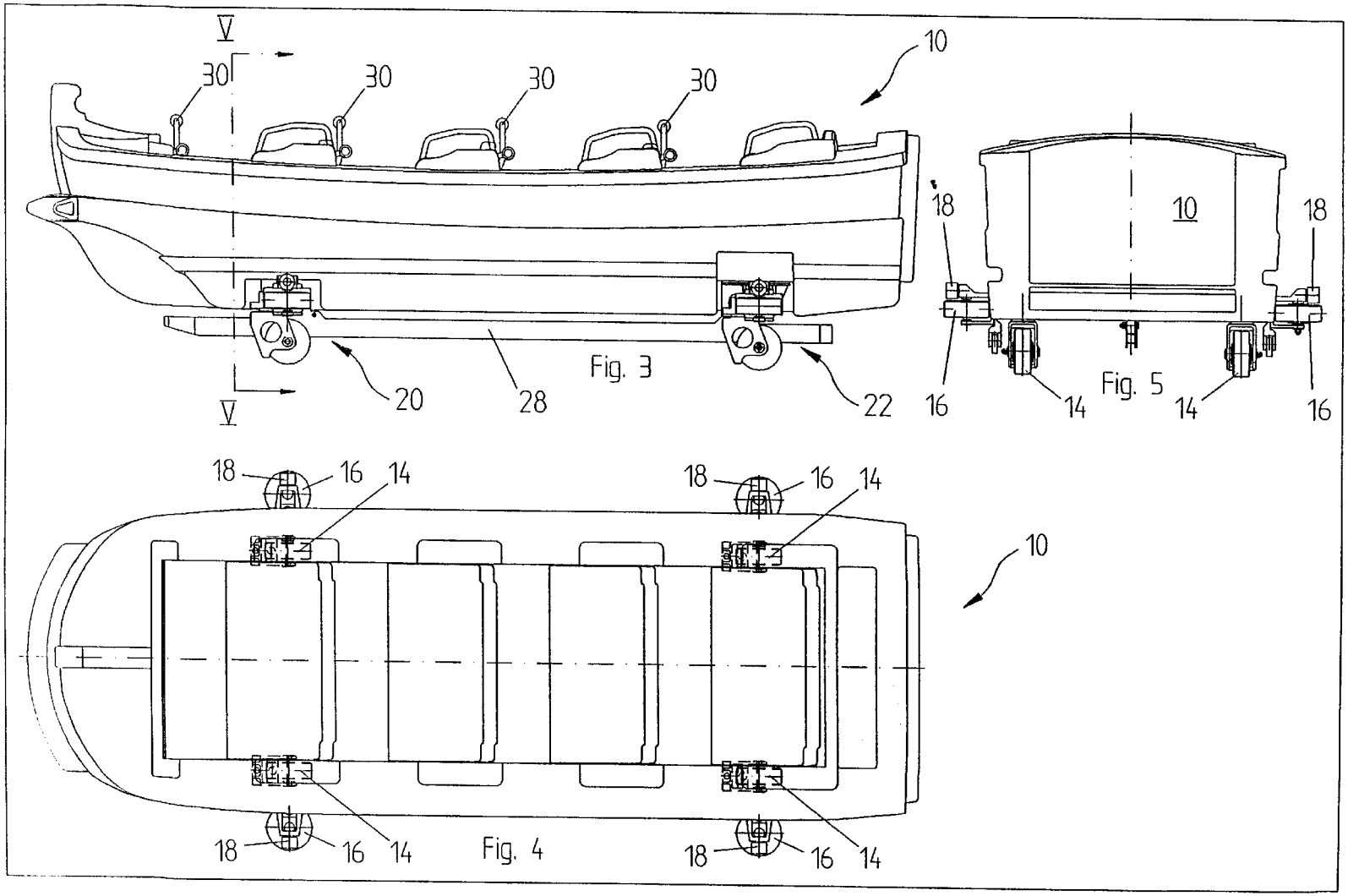
FIG. 3 is a side view of the boat.
FIG. 4 is a top view according to FIG. 3.
FIG. 5 is a section along line V—V in FIG. 3.

It is evident from FIGS. 3 to 5 that the running wheels 14, the lateral guide wheels 16, and the safety wheels 18 are each located on corresponding axles 20, 22. The front axle 20 of the boat 10 is forward of the rear axle 22. From the side view of the boat 10 shown in FIG. 3, it is evident that the respective axles 20, 22 of the running gear 12 carry the running wheels 14, the lateral guide wheels 16, and the safety wheels 18 so that the respective axles 20, 22 can be attached as a unit to boat 10. In addition, it is evident from FIG. 3 that in order to hold the passengers, safety bars 30 are provided which are lockable during operation at, for example, the lower abdomen of the passengers.

In FIG. 4 the top view of the boat 10 according to FIG. 3 clearly shows that the lateral guide wheels 16 project outward along with corresponding ones of the safety wheels 18 from the side of the boat 10. The cross section of the boat 10 shown in FIG. 5 is essentially identical to the cross section shown in FIG. 1 so that further description is not necessary.

Figures 6, 7, 8:
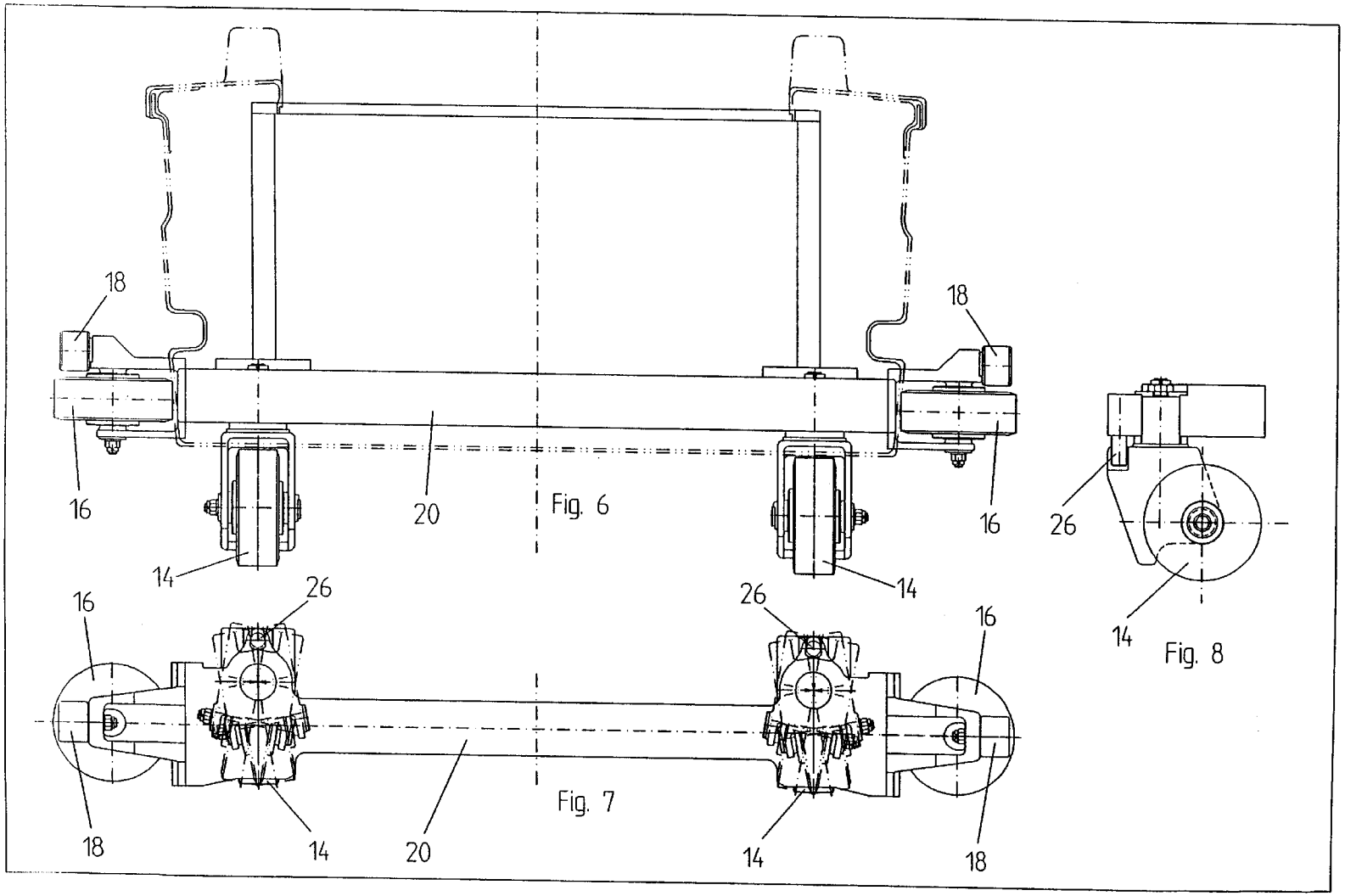
FIG. 6 is a view of the front axle together with the wheels in a front view.
FIG. 7 is a top view of the front axle according to FIG. 6.
FIG. 8 is a side view of the front axle according to FIG. 6.

The design of front axle 20 is illustrated in FIGS. 6 to 8. The front view of the front axle 20 shown in FIG. 6 is essentially the same as the corresponding views in FIGS. 1 and 5, so that a detailed description is not necessary.

It is shown in FIG. 7 that the running wheels 14 of the front axle 20 are pivotable around a respective vertical axis in order to better follow the rails 32, since the front axle 20 may be made to be rigid. Advantageously, the running wheels 14 of the rear axle 22 are likewise suspended pivotably. In order to keep the running wheels 14 from overturning, a limiting pin 26 may be located in a rear area of the suspension for the running wheels 14. The pin 26 may extend in a direction of the vertical axis of the boat 10. The limiting pin 26 is surrounded by a forked end area of a mount for the running wheel 14, with a distance between prongs of the fork being chosen so that only a limited pivot angle is possible. As is shown in FIG. 8, in which the mount for the running wheel 14 is shown partially sectioned, the limiting pin 26 engages sufficiently deeply into the mount for the running wheel in the fork-shaped section.

Figure 9:
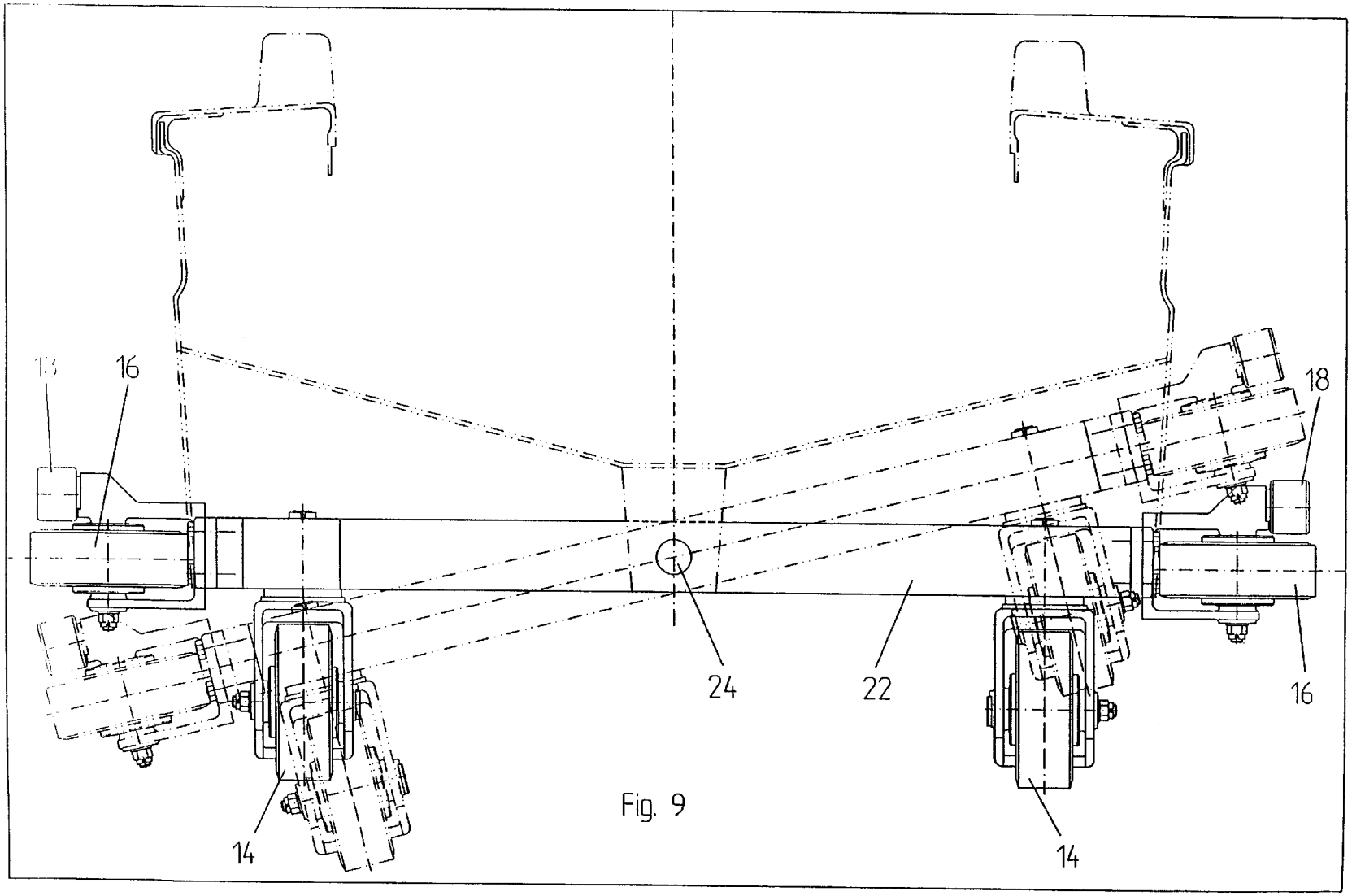
FIG. 9 is a front view of the pivotable rear axle, with the neutral position indicated by solid lines and the pivoted position indicated by dashed lines.

FIG. 9 shows schematically a cross section through the boat 10 in a vicinity of the rear axle 22. The rear axle 22 is pivotable about a lengthwise axis of the boat 10, namely around a pivot bearing 24 located in a middle portion of the rear axle 22. In FIG. 9, a neutral position of the rear axle 22 is indicated by solid lines while a pivoted position is indicated by dashed lines. The underside of the boat 10 in a vicinity of the rear axle 22 is so designed that desired pivoting of the rear axle 22 is possible. A restoring device is provided to engage the rear axle 22 in order to bias the rear axle 22 into the neutral position in an unloaded state. The return device is not shown in FIG. 9, but can be provided in the vicinity of pivot bearing 24 in the form of a spring device.

The boat 10, either after a certain portion of the ride or at the end of the ride, can be braked by a corresponding braking device engaging a brake strip 28 that is mounted in a lengthwise direction of the boat 10 on an underside thereof, as illustrated in FIG. 3. The brake strip 28 may also serve for keel-like stabilization of the boat 10 in a canal containing water when the boat 10 is floating in the canal. The lifetime of the running gear 12 is increased by designing the running gear 12 to be operated under water.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A boat for an amusement ride having a running gear that comprises:

a plurality of axles including a front axle and a rear axle, and a plurality of running wheels and lateral guide wheels to accept a force exerted by a travel path of the amusement ride, said guide wheels having a safety device located above the guide wheels and designed to engage safety rails located along the path of the amusement ride to accept lifting forces, wherein the running wheels, lateral guide wheels, and the safety device are mounted on the axles, and wherein the front axle is mounted rigidly to the boat.

2. A boat as in claim 1 wherein the safety device includes safety wheels.

3. A boat as in claim 1 wherein the safety device includes runners.

4. A boat according to claim 1, wherein the lateral guide wheels and the safety device are located above the running wheels.

5. A boat for an amusement ride having a running gear that comprises:

a plurality of axles including a front axle and a rear axle, and a plurality of running wheels and lateral guide wheels to accept a force exerted by a travel path of the amusement ride, said guide wheels having a safety device located above the guide wheels and designed to engage safety rails located along the path of the amusement ride to accept lifting forces, wherein the running wheels, lateral guide wheels, and the safety device are mounted on the axles, and wherein the running wheels of the front and rear axles pivot and a pivot angle of running wheels is limited.

6. A boat according to claim 5, further comprising a limiting pin that limits the pivot angle and a fork-shaped extension of the running wheel mount fitting around the limiting pin.

7. A boat according to claim 6, wherein a brake strip is disposed in a lengthwise direction of the boat on an underside thereof.

8. A boat according to claim 7, wherein the running gear is operable under water.

9. A boat according to claim 8, wherein safety bars are provided to secure passengers.

10. A boat as in claim 5, wherein the safety device includes safety wheels.

11. A boat as in claim 5, wherein the safety device includes runners.

12. A boat according to claim 5, wherein the lateral guide wheels and the safety device are located above the running wheels.

13. A boat for an amusement ride having a running gear that comprises:

a plurality of axles including a front axle and a rear axle, and a plurality of running wheels and lateral guide wheels to accept a force exerted by a travel path of the amusement ride, said guide wheels having a safety device located above the guide wheels and designed to engage safety rails located along the path of the amusement ride to accept lifting forces, wherein the running wheels, lateral guide wheels, and the safety device are mounted on the axles, wherein the rear axle is pivotable about a lengthwise axis of the boat, and wherein a restoring device is provided that engages the rear axle in order to bias the rear axle into the neutral position in an unloaded state.

14. A boat according to claim 13, wherein the rear axle includes a pivot bearing.

15. A boat as in claim 13, wherein the safety device includes safety wheels.

16. A boat as in claim 13, wherein the safety device includes runners.

17. A boat according to claim 13, wherein the lateral guide wheels and the safety device are located above the running wheels.

* * * * *